United States Patent [19]

Russo

[11] 4,248,078

[45] Feb. 3, 1981

[54] AUTOMOBILE BODY CLAMP

[76] Inventor: John F. Russo, 532 Stratford Rd., South Hempstead, N.Y. 11550

[21] Appl. No.: 966,296

[22] Filed: Dec. 4, 1978

[51] Int. Cl.[3] ..... B21D 1/12; B21J 13/08

[52] U.S. Cl. ..... 72/457; 72/705; 24/81 AA; 24/81 WH

[58] Field of Search ..... 72/705, 457; 269/43, 269/152; 248/226.2, 228, 229; 24/81 A, 81 AA, 81 B, 81 BA, 81 PB, 81 WH; 294/103 R, 119

[56] References Cited

U.S. PATENT DOCUMENTS

| | | | |
|---|---|---|---|
| 289,861 | 12/1883 | Schrepel | 269/152 X |
| 2,538,449 | 1/1951 | Freshwater | 248/229 X |
| 2,736,359 | 2/1956 | Bowman | 72/705 X |
| 2,816,586 | 12/1957 | Koberle | 269/152 X |
| 2,845,983 | 8/1958 | Hanson | 72/705 X |
| 2,855,972 | 10/1958 | Greider | 72/705 X |
| 3,015,353 | 1/1962 | Brown | 72/705 X |
| 3,091,278 | 5/1963 | Padgett | 72/705 X |
| 3,108,629 | 10/1963 | Jenkins | 72/705 X |

FOREIGN PATENT DOCUMENTS

| | | | |
|---|---|---|---|
| 1408462 | 7/1965 | France | 248/229 |
| 1323163 | 7/1973 | United Kingdom | 72/705 |

*Primary Examiner*—Lowell A. Larson

*Attorney, Agent, or Firm*—A. C. Nolte, Jr.; Edward B. Hunter

[57] ABSTRACT

A clamp for use in straightening automobile bodies is adapted for securement to a rocker panel and has two sets of jaws, one of which may be clamped to a top region of said rocker panel assembly and the other which may be clamped to a bottom portion of said rocker panel. Means are provided for adjusting the spacing between the two sets of jaws to accommodate different sizes of rocker panel.

3 Claims, 3 Drawing Figures

FIG. 2
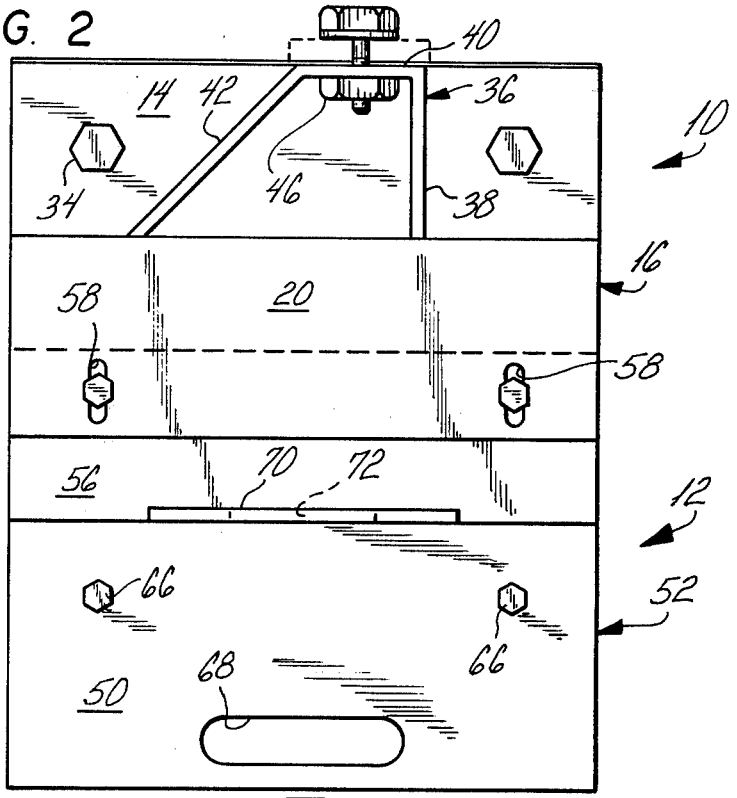
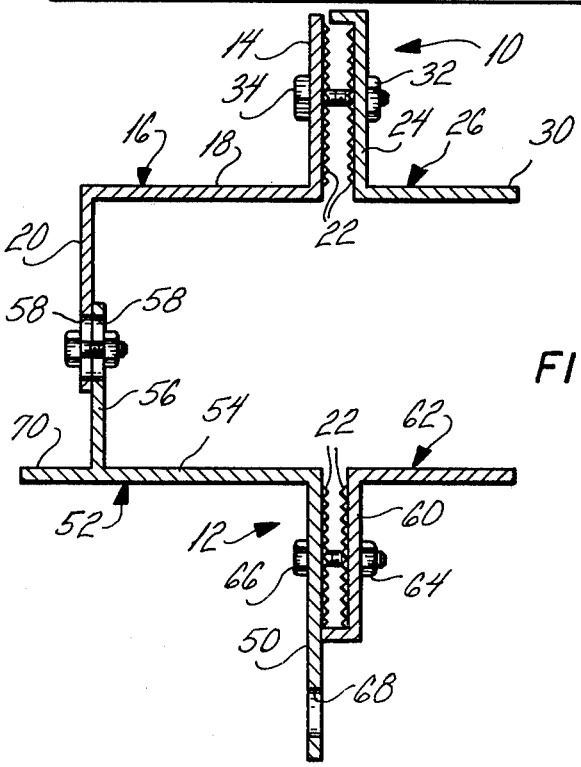
FIG. 3

AUTOMOBILE BODY CLAMP

BACKGROUND OF THE INVENTION

This invention is concerned with an automobile body clamp, that is to say, with a clamp of the kind which is secured to the part of the automobile frame to provide an anchor point for the application of a straightening or rectifying force. The invention is particularly concerned with the provision of such a clamp useful with so- called unitized frames.

DESCRIPTION OF PRIOR ART

Unitized automobile frames commonly have box section elements with projecting portions which are pinch-welded together to complete the frame section. It is to these projecting portions that the clamps of the prior art have been secured. Typical prior art clamps are illustrated in U.S. Pat. Nos. 3,091,278 (Padgett); 3,108,629 (Jenkins) and 4,070,899 (Venalainen). In each one of these patents there is disclosed a clamp for use with a unitized automobile frame in which there are a pair of jaw like members which engage a projecting portion of the frame. In each instance a single projecting portion is clamped between the jaw like elements and it is commonly known that as the straightening or rectifying force is applied to those clamped elements there is a tendency for the clamps to slip from the frame elements.

BRIEF SUMMARY OF THE INVENTION

The present invention seeks to avoid this problem by providing a clamp with jaw members which clamp projecting portions of a frame element at opposite sides of the frame element thus precluding any tendency for slippage during the application of a straightening force.

The rocker panel assembly of a unitized automobile body is a common attachment point for clamps of the kind with which the present invention is concerned. These panels conventionally have longitudinally extending projecting portions on both the upper and lower surfaces on the panel at which portions the welding of the components of the frame element is effected. The present invention seeks to provide a clamp which has two spaced sets of jaws, one set of which cooperates with the projecting portion at one side of the rocker panel and the other set of which engages a projecting portion at the opposite side of the frame element.

DESCRIPTION OF THE FIGURES OF THE DRAWINGS

An embodiment of the present invention is illustrated schematically in the accompanying drawings, in which:

FIG. 2 is a side view of a clamp of FIG. 1; and

FIG. 3 is a cross sectional view of a clamp shown in FIG. 1.

DESCRIPTION OF THE PREFERRED EMBODIMENT

Figure 1:
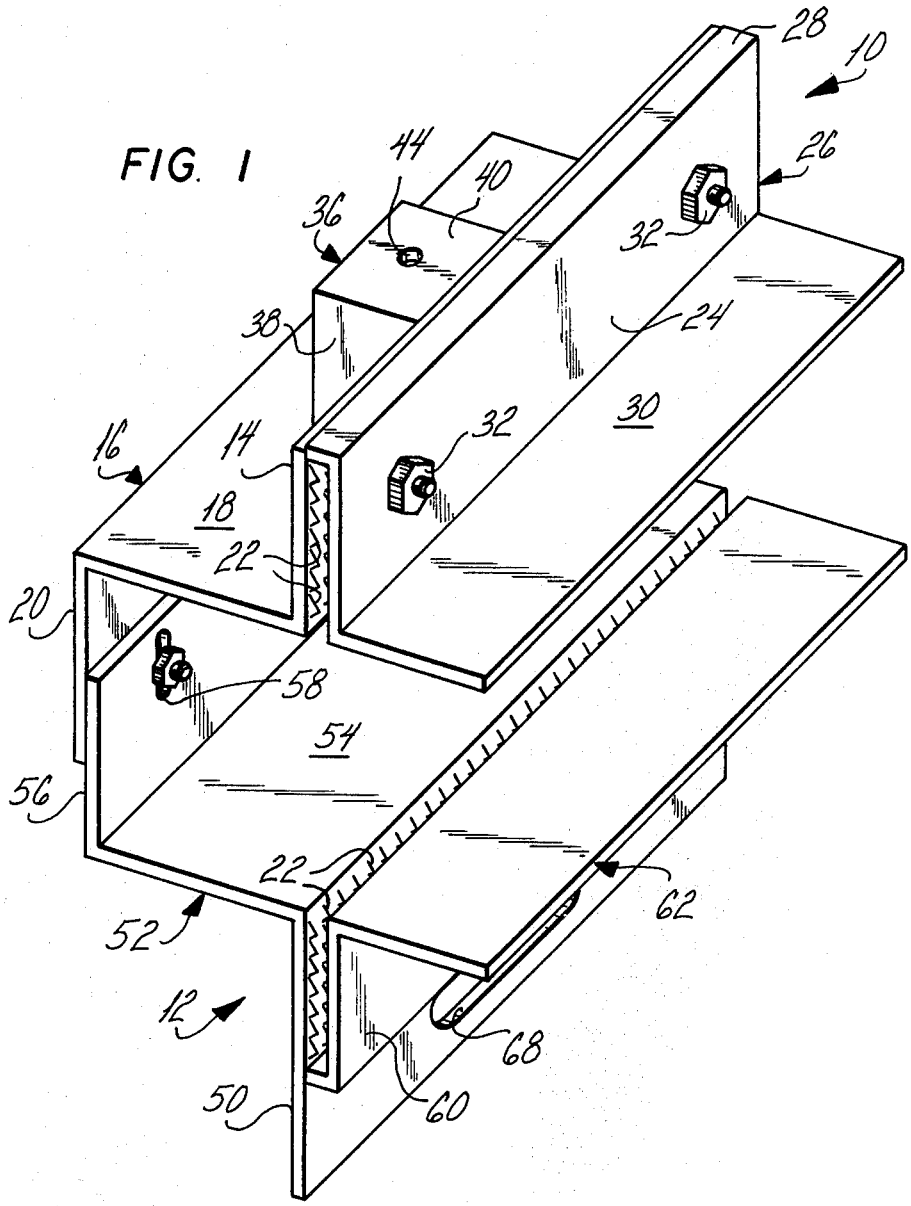
FIG. 1 is a perspective view of a clamp according to the present invention.

The clamp in the drawings comprises a first set of jaws indicated generally at 10 and a second set of jaws indicated at 12. The jaw set 10 comprises a first jaw member 14 constituted by an upright flange of a Z section body portion 16. The body additionally comprises a horizontal web 18 and a downwardly depending flange portion 20. The gripping face 22 of the jaw 14 is provided with teeth-like projections to improve the grip of that jaw upon an item to which it is applied. The second jaw of set 10 is constituted by an intermediate, vertical web 24 of a Z section body element 26. Horizontally disposed flange 28 of the section 26 extends towards the upper edge of jaw 14, while horizontal flange 30 extends to the opposite side of web 24 from that side to which flange 28 projects. Secured, as for example by welding, to the web 24 are screw threaded nut-like elements 32 which cooperate, in a manner described hereinafter, with bolt-like elements 34 (see FIG. 3) to cause the jaws to be brought towards each other and moved away from each other as desired.

Secured to the web 18 of section 16 is a support element 36 comprising an upright wall 38, a flat top wall 40 and an inclined wall 42. The wall 40 has an opening 44 which registers with the threaded opening of a nut like element 46 (see FIG. 2) welded to the underside of the wall 40.

One jaw of the set of jaws 12 is constituted by a vertically disposed flange 50 of a Z section element 52 of which the horizontal web 54 connects flange 50 with upright flange 56. Flange 56 is provided with spaced apart slotted openings 58 as is flange 20 of body portion 16 so that the bodies 16 and 52 may be joined together by nut and bolt like elements passed through those openings.

The second jaw of set 12 is constituted by vertically disposed web 60 of Z shaped element 62 and the confronting faces of jaws 50 and 60 are appropriately toothed, firmly to engage an element disposed between the jaws. Web 60 has nut- like elements 64 secured to it and bolt elements 66 passed through flange 50 engage those nut like elements to secure element 62 to element 52.

As can be seen particularly in FIGS. 2 and 3, flange 50 extends downwardly below the web 60 and is provided with an opening 68 for a purpose described hereinafter. Additionally a central portion 70 of web 54 extends beyond flange 56 and is provided with an opening 72, the purpose of which will become apparent from the following description.

The clamp illustrated in the drawings is one specifically adapted for securement to a rocker panel assembly of a unitized automobile body. It is entirely conventional for said rocker panel assemblies to be of box section having welded seams upstanding from the top and bottom walls of the box section. According to this invention the set of jaws 10 is adapted to engage the projecting seam of the rocker panel at the top of that panel while the jaws of set 12 engage the seam projecting from the bottom surface of the rocker panel.

It will be appreciated that the slotted opening, 58 of the upright flanges 20 and 56 of section 16 and 52 respectively, permit the clamp to be adjusted for any height of rocker panel while so long as the web portions 18 and 54 of sections 16 and 52 respectively are of greater width than the spacing of the projecting seam portion of the rocker panel unit from the outer most edges of the rocker panel unit, it will be apparent that the jaws can be adjusted to accommodate different sizes of rocker panel.

By clamping both above and below the rocker panel as distinct from the prior art structures in which clamping occurs only at one of these locations (generally at the top of the panel) the tendency for the clamp to become disengaged from the panel upon the application of rectifying or straightening forces is substantially eliminated.

The opening 68 provides a location through which a bar for extension transversely across the automobile can be disposed, the other end of the bar being received in a similar opening of a clamp at the opposite side of the automobile body. Additionally, the opening 72 permits the engagement of a force transmitting element to provide for the application of other straightening forces.

The wall 40 of unit 36 provides means for supporting a transverse strap which again unites clamps at opposite sides of the automobile body and the sloping wall 42 provides a reaction surface for reception of one end of the force transmitting element, such as a jack, the other end of which may be disposed, for example, against the fire wall of the automobile.

It will be appreciated that the present invention is subject to many variations which do not deviate from its scope. As circumstances dictate additional attachment points may be provided and, of course, the means for grasping the structural elements of the automobile frame can be varied to accommodate different automobile body formations.

I claim:

1. Device for repairing damaged automobile frame elements or the like, comprising means for simultaneously clamping a projecting portion of said frame element at opposite sides of such element, said clamping means comprising a pair of coacting spaced clamps, each of said clamps comprising a set of two jaws consisting of a first jaw member constituted by a vertical flange of a "z" section body having a horizontal web, a slotted projecting flange portion and a gripping face with teeth-like projections, and a second jaw member constituted by an intermediate vertical web of a "z" section body element having a horizontally disposed flange entending toward the vertical flange of the first jaw and a horizontally disposed flange extending from the opposite side of said vertical web, and means for securing the slotted projecting flange portions of the first jaw of each set of jaws in overlapping relationship with each other to maintain said clamps in spaced relation.

2. The device of claim 1 further characterized in that said slotted overlapping flange portions comprise means for permitting adjustment of the space between said clamps.

3. The device of claim 1 further characterized in that means are provided for moving the two jaws of each set of jaws toward and away from each other independently of movement of the jaws of the other set.

* * * * *

UNITED STATES PATENT AND TRADEMARK OFFICE

CERTIFICATE OF CORRECTION

PATENT NO. : 4,248,078

DATED : February 3, 1981

INVENTOR(S) : John F. Russo

It is certified that error appears in the above-identified patent and that said Letters Patent are hereby corrected as shown below:

In column 4, Line 11, word 2 [entending] should be extending

Signed and Sealed this

Twelfth Day of May 1981

[SEAL]

Attest:

RENE D. TEGTMEYER

Attesting Officer

Acting Commissioner of Patents and Trademarks